US006408780B1

(12) United States Patent
Ozaki et al.

(10) Patent No.: US 6,408,780 B1
(45) Date of Patent: Jun. 25, 2002

(54) WAVE-RESISTANT MEGA-FLOAT

(76) Inventors: Masahiko Ozaki; Shuji Mizokami; Makoto Ohta, all of c/o Nagasaki Research & Development Center Mitsubishi Heavy Industries, Ltd., 717-1, Fukahori-machi 5-chome, Nagasaki, Nagasaki-ken (JP); Ikuo Hosomi, c/o Nagasaki Shipyard & Machinery Works Mitsubishi Heavy Industries, Ltd., 1-1, Akunoura-machi, Nagasaki, Nagasaki-ken (JP)

( * ) Notice: Subject to any disclaimer, the term of this patent is extended or adjusted under 35 U.S.C. 154(b) by 0 days.

(21) Appl. No.: 09/430,317

(22) Filed: Oct. 29, 1999

(30) Foreign Application Priority Data

Oct. 30, 1998 (JP) ..... 10-311342

(51) Int. Cl.[7] ..... B63B 35/44

(52) U.S. Cl. ..... 114/264; 114/266; 114/267; 405/21; 405/26; 405/212

(58) Field of Search ..... 114/126, 264, 114/265, 266, 267, 263, 44, 45; 405/212, 218, 219, 21, 26, 27

(56) References Cited

U.S. PATENT DOCUMENTS

| | | | | | |
|---|---|---|---|---|---|
| 1,356,300 | A | * | 10/1920 | McIntyre et al. | 114/39.24 |
| 1,846,278 | A | * | 2/1932 | Roane | 405/27 |
| 2,752,874 | A | * | 7/1956 | Held | 114/126 |
| 3,152,568 | A | * | 10/1964 | Mayer | 114/266 |
| 3,222,871 | A | * | 12/1965 | Miller et al. | 405/27 |
| 3,800,543 | A | * | 4/1974 | Moore | 405/26 |
| 3,969,901 | A | * | 7/1976 | Matsudaira et al. | 405/23 |
| 4,182,255 | A | * | 1/1980 | Reid | 114/126 |
| 4,225,268 | A | * | 9/1980 | Treu | 405/27 |
| 4,232,623 | A | * | 11/1980 | Chou et al. | 114/125 |
| 4,729,335 | A | * | 3/1988 | Vidovic | 114/266 |
| 4,997,310 | A | * | 3/1991 | Rasmussen | 405/26 |
| 5,875,729 | A | * | 3/1999 | Simola | 114/267 |
| 6,102,625 | A | * | 8/2000 | Olsen et al. | 405/195.1 |

FOREIGN PATENT DOCUMENTS

| | | | | |
|---|---|---|---|---|
| CA | 826383 | * | 11/1969 | 405/27 |
| DE | 3522079 | * | 1/1987 | 114/126 |
| DE | 4119430 | * | 12/1992 | 114/126 |
| FR | 2322776 | * | 7/1993 | 114/126 |
| JP | 56-89609 | * | 7/1981 | 405/26 |
| JP | 56-100911 | * | 8/1981 | 405/26 |
| JP | 58-83712 | * | 5/1983 | 405/26 |
| JP | 68292 | * | 3/1990 | 114/264 |
| JP | 405178282 | * | 7/1993 | 114/126 |

* cited by examiner

*Primary Examiner*—S. Joseph Morano
*Assistant Examiner*—Ajay Vasudeva

(57) ABSTRACT

A wave-resistant mega-float comprises a first flat plate provided on a front end portion of a large-sized floating body, penetrating a water surface, and extending downward below a bottom surface of the floating body, the front end portion of the floating body being located on an upstream side in a direction from which waves travel, and a second flat plate attached substantially perpendicularly to a lower end portion of the first flat plate such that the second flat plate extends toward the upstream side.

10 Claims, 9 Drawing Sheets

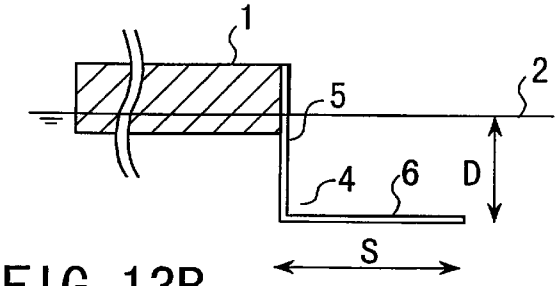
FIG. 13B
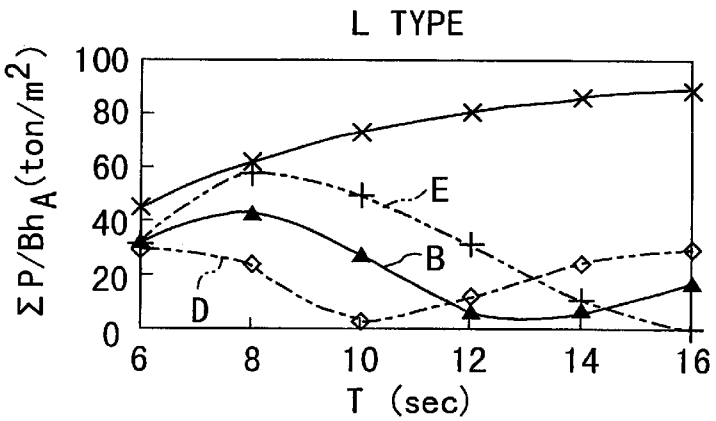
FIG. 13D
L TYPE
| | SIZE | | REMARKS |
|---|---|---|---|
| | D (m) | S (m) | |
| L TYPE A | 8 | 18 | △ |
| L TYPE B | 10 | 18 | ○ |
| L TYPE C | 12 | 18 | ◎ |
| L TYPE D | 10 | 14 | ◎ |
| L TYPE E | 10 | 22 | △ |
FIG. 13A
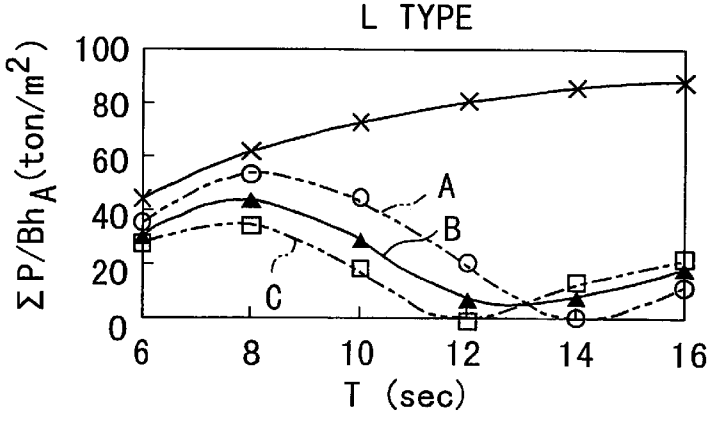
FIG. 13C

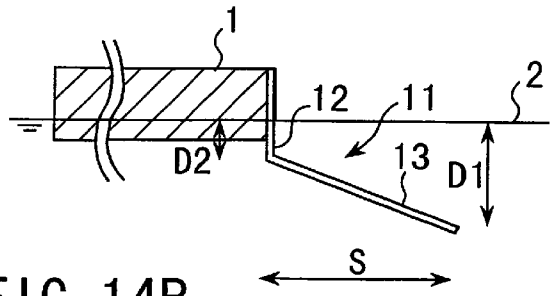
FIG. 14B
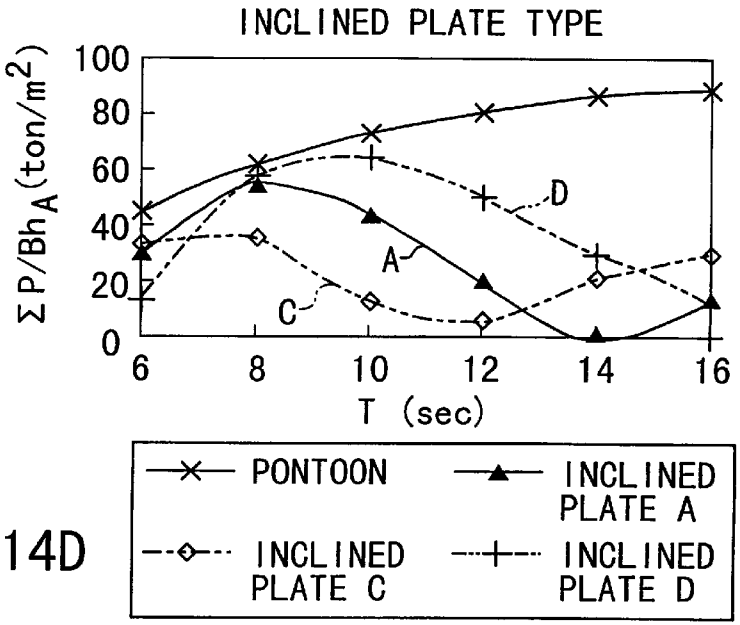
FIG. 14D
| INCLINED PLATE TYPE | SIZE | | | REMARKS |
|---|---|---|---|---|
| | D1 (m) | D2 (m) | S2 (m) | |
| INCLINED PLATE A | 10 | 2 | 18 | ○ |
| INCLINED PLATE B | 10 | 6 | 18 | ◎ |
| INCLINED PLATE C | 10 | 2 | 14 | ◎ |
| INCLINED PLATE D | 10 | 2 | 22 | × |
FIG. 14A
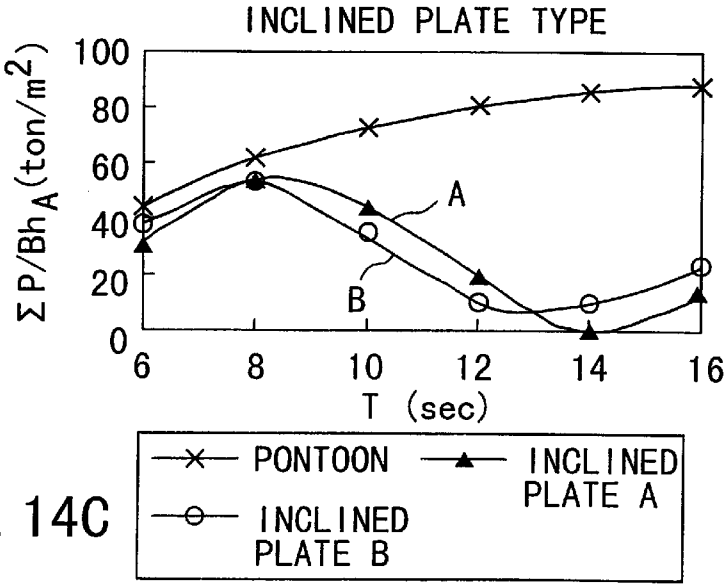
FIG. 14C

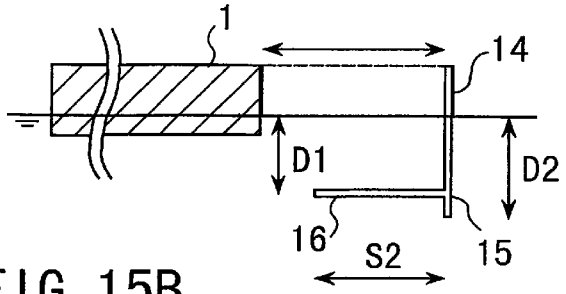
FIG. 15B
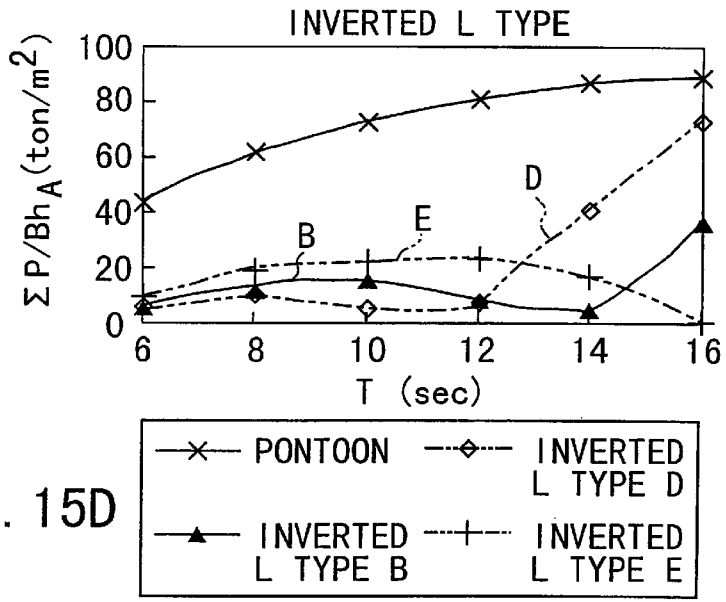
FIG. 15C
FIG. 15D
INVERTED L TYPE (S1=18m)
| | SIZE | | | REMARKS |
|---|---|---|---|---|
| | D1 (m) | D2 (m) | S2 (m) | |
| INCLINED PLATE A | 8 | 8 | 15 | ◎ |
| INCLINED PLATE B | 10 | 10 | 15 | ◎ |
| INCLINED PLATE C | 12 | 12 | 15 | ◎ |
| INCLINED PLATE D | 10 | 10 | 11 | △ |
| INCLINED PLATE E | 10 | 10 | 19 | ○ |
FIG. 15A L TYPE HAVING OPENING HOLE (S1=18m)
| | SIZE | | | REMARKS |
|---|---|---|---|---|
| | D (m) | S2 (m) | S3 (m) | |
| L TYPE HAVING OPENING HOLE A | 12 | 15 | 2 | ○ |
| L TYPE HAVING OPENING HOLE B | 12 | 10 | 2 | ○ |
| L TYPE HAVING OPENING HOLE C | 12 | 5 | 2 | ◎ |
| L TYPE HAVING OPENING HOLE D | 12 | 4 | 4 | ○ |
| L TYPE HAVING OPENING HOLE E | 12 | 3 | 6 | ○ |
FIG. 16A
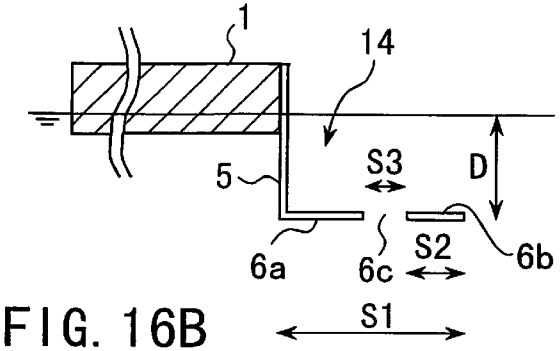
FIG. 16B
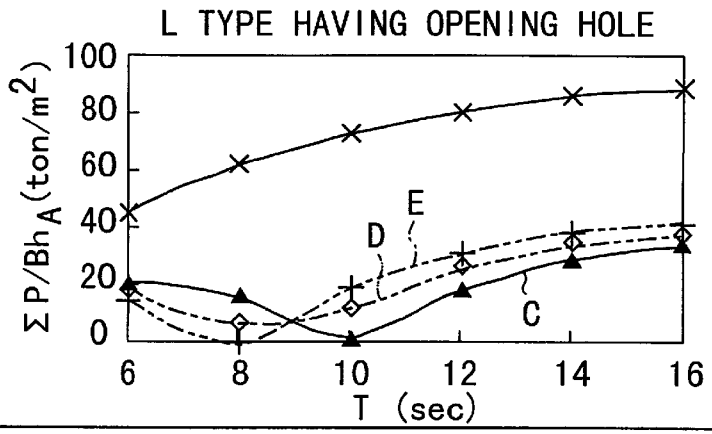
FIG. 16C
FIG. 16D INVERTED L TYPE HAVING OPENING HOLE (S=18m, S1=15m)
| | SIZE | | | REMARKS |
|---|---|---|---|---|
| | D (m) | S2 (m) | S3 (m) | |
| L TYPE HAVING OPENING HOLE A | 12 | 5 | 2 | ○ |
| L TYPE HAVING OPENING HOLE B | 12 | 10 | 2 | × |
| L TYPE HAVING OPENING HOLE C | 10 | 5 | 2 | ○ |
| | | | | |
| | | | | |
FIG. 17A
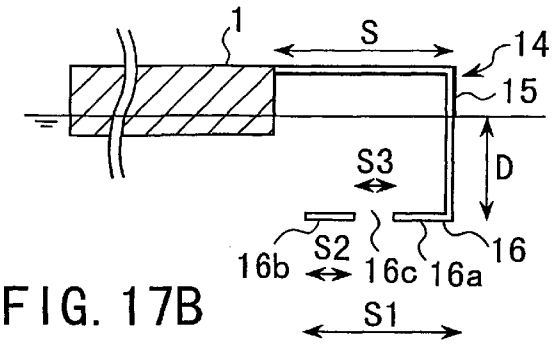
FIG. 17B
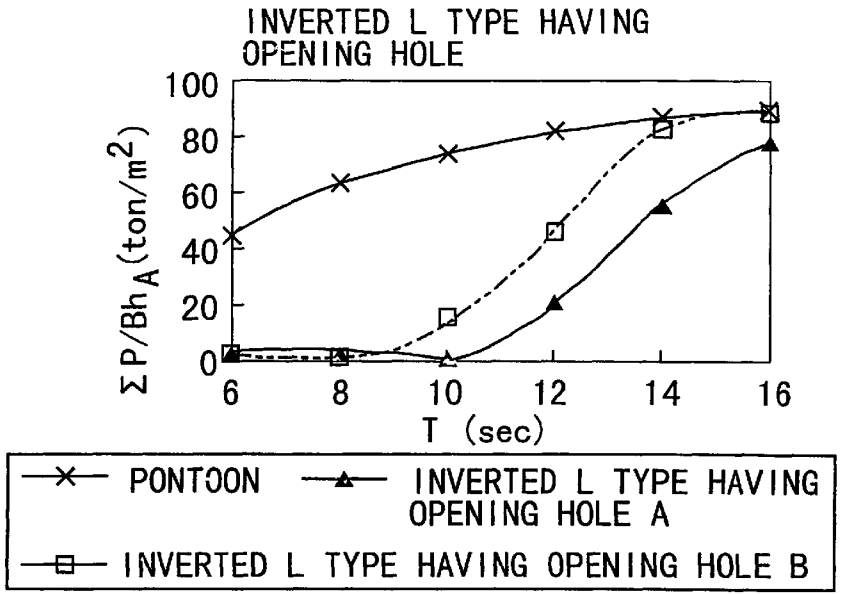
FIG. 17C
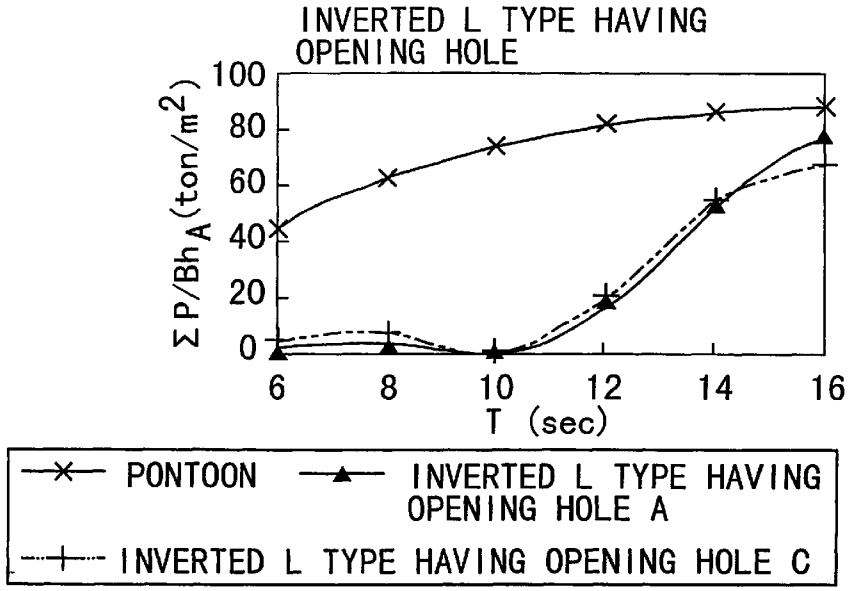
FIG. 17D

WAVE-RESISTANT MEGA-FLOAT

BACKGROUND OF THE INVENTION

The present invention relates to a large-sized float with wave-resistant properties (hereinafter referred to as "wave-resistant mega-float"), such as a large-sized floating structure, a floating bridge, floating warehouse, etc., floating on the ocean, the fluctuation of the mega-float due to incident waves being reduced.

Development of mega-floats floating on the ocean has been promoted. A conventional mega-float is a box-shaped floating structure disposed in a calm sea area created by a stationary breakwater. The floating structure includes a plurality of sealed floating chambers and has a flat deck and a flat bottom.

Mega-floats are thus applicable to various purposes, for example, offshore airports (including offshore heliports), offshore plant barges and, prospectively, offshore cities.

FIG. 1 shows a mega-float provided with a stationary breakwater. A stationary breakwater b is set on a seabed a, thereby creating a calm sea area c. In addition, a mega-float e is floated in the calm sea area c. Mooring-posts d are provided so as to surround the mega-float e. The mega-float is moored to the mooring-posts d via dampers f. The mega-float e has, for example, a length of 1500 m, a width of 500 m, a thickness of 7 m and a draft of 2 m. The thickness of the mega-float e is less than the length thereof.

Analytic calculations were conducted for elastic response in waves at a depth of 20 m, with the direction of waves, the cycle of waves and the flexural rigidity of mega-float e being systematically varied. It was found that design specifications are not satisfactory even when the limit wave height is 2 m.

If the depth of water increases, the cost for installing the stationary breakwater b becomes very high. If the stationary breakwater b is replaced with a floating breakwater, approach to the pier or stevedoring becomes difficult. Under the circumstances, there is a demand for mega-floats which require neither stationary breakwaters or floating breakwaters.

In order to dispense with the stationary breakwater b or the floating breakwater without increasing the cost or adversely affecting vessels, etc., it is necessary to provide the mega-float e itself with a fluctuation reducing means, thereby enhancing wave-resistant properties. According to one possible method, a wave-damping structure is added to that side portion of the mega-float e, which is located upstream in a direction in which waves travel, thereby reducing incoming waves to the mega-float e. In the prior art, as shown in FIG. 2, a wave-damping structure g is fixed to a front end portion h of the mega-float e, which is located upstream in the direction from which waves travel.

The conventional wave-damping structure g is devised by utilizing a mechanism for reflecting, scattering or breaking waves. There types of the structure g are publicly known: a curtain wall type structure (FIG. 3A); an open tank-plate type structure (FIG. 3B); and an (immersed) beach type structure (FIG. 3C).

The curtain wall type structure is effective only to short-wavelength components. The open tank-plate type structure or beach type structure gradually breaks the waves, and are thus effective to both short- and long-wavelength components. Experimental data, however, shows that a considerable length (e.g. about ⅓ of the wavelength) is necessary in order to obtain a sufficient wave-damping effect. If the wavelength is 200 m, the length of the structure needs to be 70 m to 80 m, resulting in an increase in size and cost.

The present invention has been made in consideration of the above circumstances and its object is to provide a wave-resistant mega-float capable of efficiently damping waves with a simple-structured wave-damping member provided on the mega-float and reducing fluctuation due to wide-range wave cycles and high waves, without installing a stationary breakwater, etc.

BRIEF SUMMARY OF THE INVENTION

In order to achieve the object, according to a first aspect of the invention, there is provided a wave-resistant mega-float comprising:

a first flat plate provided on a front end portion of a large-sized floating body, penetrating a water surface, and extending downward below a bottom surface of the floating body, the front end portion of the floating body being located on an upstream side in a direction from which waves travel; and a second flat plate attached to a lower end portion of the first flat plate such that the second flat plate extends toward the upstream side.

With this invention, as will be described later in detail, when waves come in from the upstream side while the mega-float floats on the sea, a fluctuating pressure on the immersed horizontal plate of the wave-damping member (second flat plate) (with a value obtained by subtracting a pressure on the upper surface of the immersed horizontal plate from a pressure on the lower surface of the plate) and a fluctuating pressure on the bottom surface of the front end portion of the mega-float have opposite phases and cancel each other. Consequently, a pressure integration value of wave (wave force) acting on the front end portion of the mega-float decreases and the fluctuation can be reduced.

According to a second aspect of the invention, there is provided a wave-resistant mega-float comprising:

a first flat plate provided on a front end portion of a large-sized floating body, penetrating a water surface, and extending downward below a bottom surface of the floating body, the front end portion of the floating body being located on an upstream side in a direction in which waves travel; and a second flat plate attached to a lower end portion of the first flat plate and extending toward the upstream side in an inclined downward direction.

With this invention, as will be described later in detail, when waves have come in from the upstream side while the mega-float floats on the sea, a fluctuating pressure on the immersed horizontal plate of the wave-damping member (second flat plate) (with a value obtained by subtracting a pressure on the upper surface of the immersed horizontal plate from a pressure on the lower surface of the plate) and a fluctuating pressure on the bottom surface of the front end portion of the mega-float have opposite phases and cancel each other. Consequently, a pressure integration value of wave (wave force) acting on the front end portion of the mega-float decreases and the fluctuation can be reduced.

According to a third aspect of the invention, there is provided a wave-resistant mega-float comprising:

a first flat plate provided on a front end portion of a large-sized floating body, which front end portion is located on an upstream side in a direction from which waves travel, the first flat plate extending toward the upstream side;

a second flat plate attached to the first flat plate, the second flat plate penetrating a water surface and extending downward below a bottom surface of the floating body; and a third flat plate attached to the second flat plate and extending toward the floating body.

With this invention, as will be described later in detail, when waves have come in from the upstream side while the mega-float floats on the sea, a fluctuating pressure on the immersed horizontal plate of the wave-damping member (second flat plate) (with a value obtained by subtracting a pressure on the upper surface of the immersed horizontal plate from a pressure on the lower surface of the plate) and a fluctuating pressure on the bottom surface of the front end portion of the mega-float have opposite phases and cancel each other. Consequently, a pressure integration value of wave (wave force) acting on the front end portion of the mega-float decreases and the fluctuation can be reduced.

In the above inventions, an extension deck extending toward the upstream side from the upper end of the first flat plate may be provided. Thereby, the area of the deck of the mega-float can be increased and vessels, etc. are prevented from colliding with the immersed horizontal plate provided on the front side of the mega-float.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 13A shows sizes of wave-damping members;

FIG. 13B shows a wave-damping member as in first embodiment;

FIG. 13C shows calculation results on pressure integration in a range of 50 m from the front end of the mega-float, with the dimensions of the L-shaped wave-damping member varied systematically;

FIG. 13D shows calculation results on pressure integration in a range of 50 m from the front end of the mega-float, with the dimensions of the L-shaped wave-damping member varied systematically;

FIG. 14A shows sizes of a wave-damping member;

FIG. 14B shows a wave-damping member as in second embodiment;

FIG. 14C shows calculation results on pressure integration in a range of 50 m from the front end of the mega-float, with the dimensions of the inclined plate type wave-damping member varied systematically;

FIG. 14D shows calculation results on pressure integration in a range of 50 m from the front end of the mega-float, with the dimensions of the inclined-plate type wave-damping member varied systematically;

FIG. 15A shows sizes of a wave-damping member;

FIG. 15B shows a wave-damping member as in third embodiment;

FIG. 15C shows calculation results on pressure integration in a range of 50 m from the front end of the mega-float, with the dimensions of the reversed-L-shaped wave-damping member varied systematically;

FIG. 15D shows calculation results on pressure integration in a range of 50 m from the front end of the mega-float, with the dimensions of the reversed-L-shaped wave-damping member varied systematically;

FIG. 16A shows sizes of a wave-damping member;

FIG. 16B shows a wave-damping member as in fourth embodiment;

FIG. 16C shows calculation results on pressure integration in a range of 50 m from the front end of the mega-float, with the dimensions of a holed L-shaped wave-damping member varied systematically;

FIG. 16D shows calculation results on pressure integration in a range of 50 m from the front end of the mega-float, with the dimensions of the holed L-shaped wave-damping member varied systematically;

FIG. 17A shows sizes of a wave-damping member;

FIG. 17B shows a wave-damping member as in fifth embodiment;

FIG. 17C shows calculation results on pressure integration in a range of 50 m from the front end of the mega-float, with the dimensions of a holed reversed-L-shaped wave-damping member varied systematically; and FIG. 17D shows calculation results on pressure integration in a range of 50 m from the front end of the mega-float, with the dimensions of the holed reversed-L-shaped wave-damping member varied systematically.

DETAILED DESCRIPTION OF THE INVENTION

Preferred embodiments of the present invention will now be described with reference to the accompanying drawings.

Figure 1:
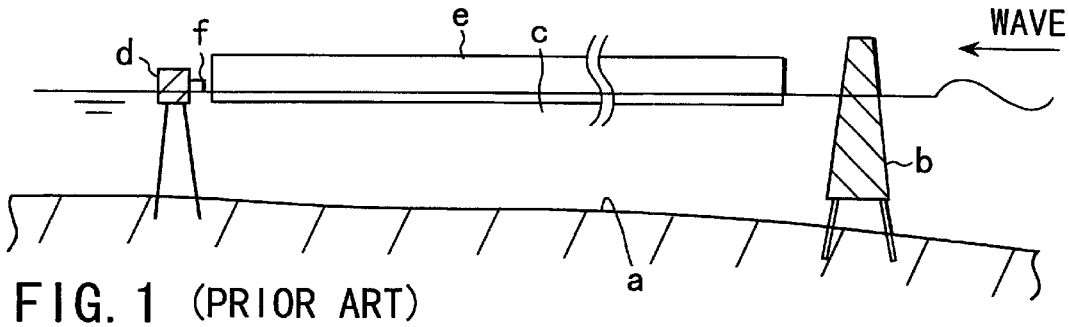
FIG. 1 (PRIOR ART)
FIG. 1 is a side view showing a prior art mega-float with a stationary breakwater.
Figure 2:
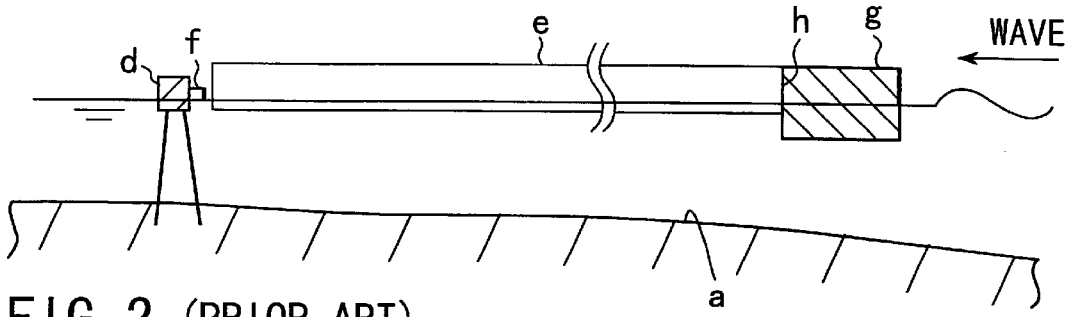
FIG. 2 (PRIOR ART)
FIG. 2 is a side view showing a prior art mega-float to which a wave-damping structure is fixed.
Figure 3A:
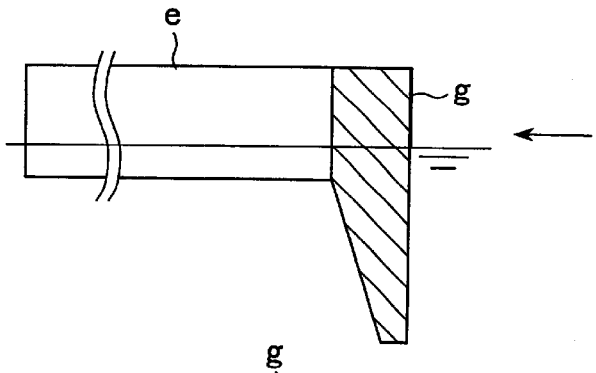
FIG. 3A (PRIOR ART)
FIGS. 3A to 3C are side views showing conventional wave-damping structures.
Figure 3B:
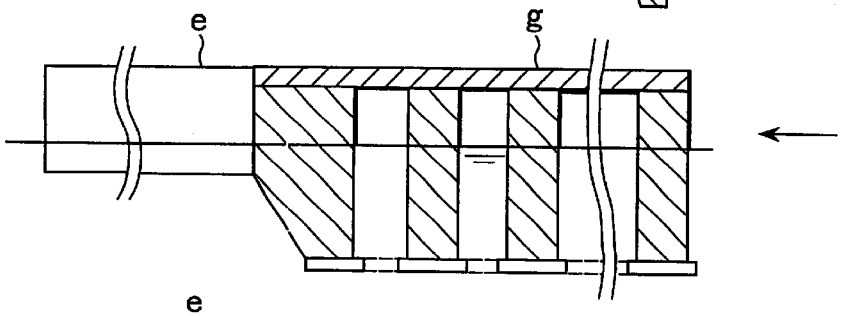
FIG. 3B (PRIOR ART)
Figure 3C:
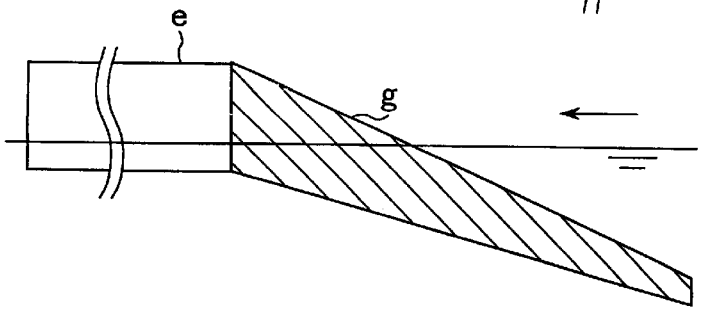
FIG. 3C (PRIOR ART)
Figure 4:
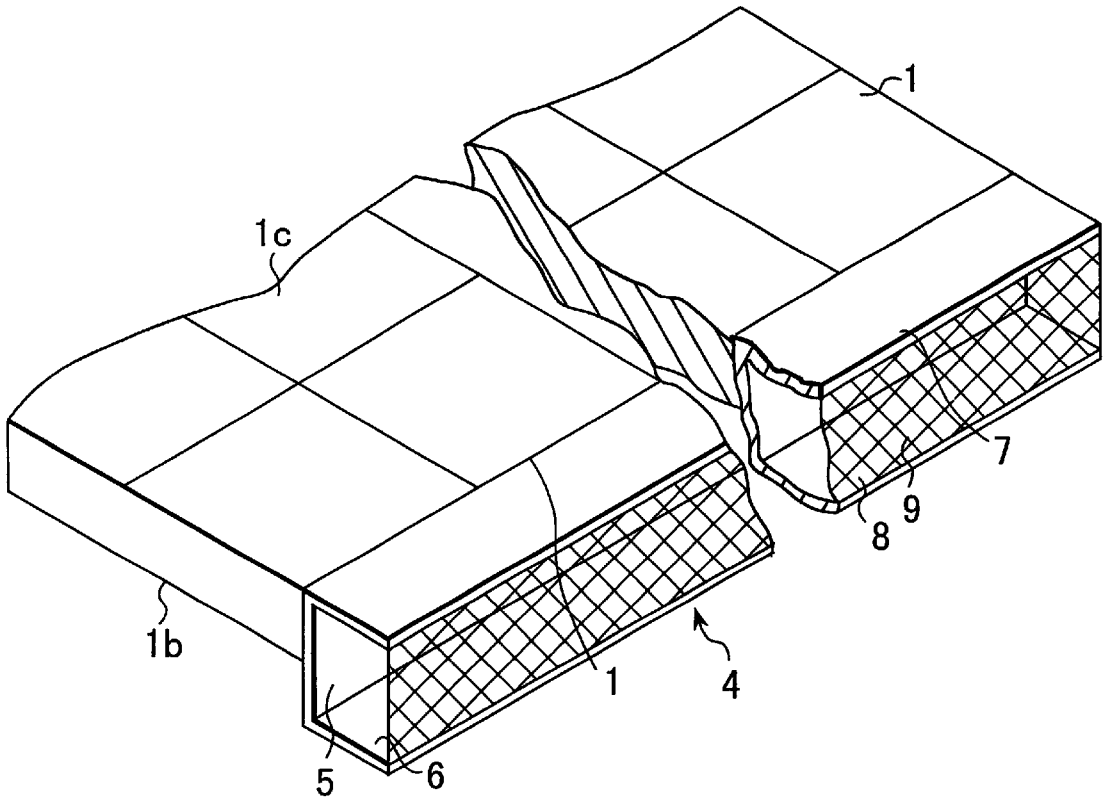
FIG. 4 is a perspective view showing a part of a wave-resistant mega-float according to a first embodiment of the present invention.
Figure 5:
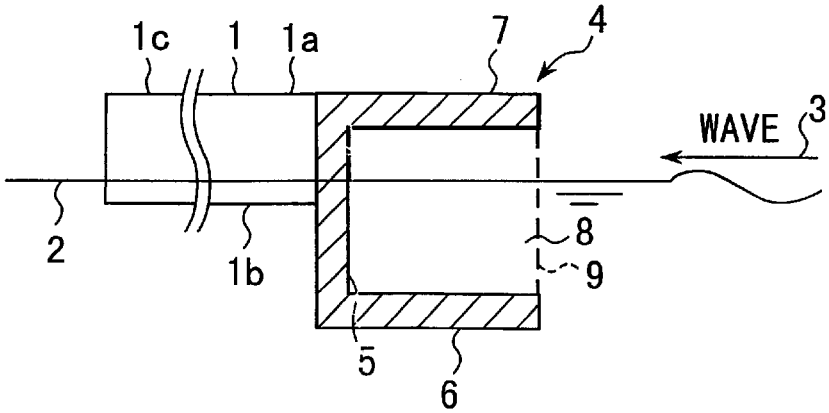
FIG. 5 is a side view of a wave-damping member according to the first embodiment.

FIG. 4 is a perspective view of a large-sized floating body (mega-float) having a very-large-sized floating offshore structure according to a first embodiment of the present invention. FIG. 5 is a cross-sectional view showing a wave-damping member used for the mega-float 1.

The mega-float 1 is formed of, e.g. a steel plate in a rectangular shape. A plurality of sealed floating chambers (not shown) are provided within the mega-float 1. The mega-float 1 floats on the sea due to a lift caused by the floating chambers. Numeral 2 denotes a draft line of the mega-float 1, and numeral 3 the direction of waves.

A wave-damping member 4 of, e.g. steel, serving as a wave-resistant structure over the entire width of the mega-float 1, is fixed to a front end portion 1*a* of the mega-float 1, which is located upstream in the direction from which waves travel. The wave-damping member 4 is formed of a vertical plate 5 and an immersed horizontal plate 6 in a substantially L-shape. The vertical plate 5 is a flat plate penetrating the water surface and extending downward from a bottom surface 1*b* of the mega-float 1. The immersed horizontal plate 6 extends integrally from a lower end portion of the vertical plate 5 to the front side (hereinafter "front side" is defined as an upstream side in a direction in which waves travel). The vertical plate 5 may slightly incline to the front or rear side. A front-end plate of the mega-float 1 may be substituted for that portion of the vertical plate 5, which overlaps the front-end plate of the mega-float 1. In this case, the vertical plate 5 appears to extend from the lower surface of the mega-float 1, but the technical significance of the vertical plate 5 is unchanged.

An extension deck 7 is provided at an upper end portion of the vertical plate 5 so as to extend to the front side horizontally in the same plane as a deck 1*c* of the mega-float 1. The extension deck 7, vertical plate 5 and immersed horizontal plate 6 constitute a substantially a square-bracket ([) shape structure. An opening portion 8 is provided at the front end portion of the square-bracket shape structure. A water passage member 9 fixed to the front end portion of the extension deck 7 and the front end portion of the immersed horizontal plate 6 is provided at the opening portion 8. The water passage member 9, which passes water, may comprise support columns arranged at proper intervals, a net-like member, a porous plate, a slit plate, or a grating member.

According to the mega-float 1 having the above described wave-damping member 4, when waves have come in from the upstream side while the mega-float 1 floats on the sea, a fluctuating pressure on the immersed horizontal plate 6 of wave-damping member 4 (with a value obtained by subtracting a pressure on the upper surface of the immersed horizontal plate 6 from a pressure on the lower surface of the plate 6) and a fluctuating pressure on the bottom surface of the front end portion 1*a* of mega-float 1 have opposite phases and cancel each other. Consequently, a pressure integration value of wave (wave force) acting on the front end portion of mega-float 1 decreases and the fluctuation can be reduced.

Moreover, the effective length of the wave-damping member 4 is about 1/10 of the wavelength. If the wavelength is 200 m, the sufficient length is about 20 m. Therefore, the size and cost of the wave-damping member 4 can be reduced.

In the present embodiment, where the water passage member 9 is formed of the net-like member, porous plate, slit plate, grating plate, etc., incoming waves are broken when they pass through the water passage member 9 and wave energy is attenuated. Accordingly, an adverse effect by the incoming waves upon the mega-float 1 including the wave-damping member 4 can be reduced.

In the present embodiment, since the wave-damping member 4 is provided with the extension deck 7, the area of the deck 1*c* of mega-float 1 can be increased and vessels, etc. are prevented from colliding with the immersed horizontal plate 6. However, the extension deck 7 is not directly related to the wave-damping action and may be omitted. In brief, from the standpoint of wave-damping performance, it should suffice if the wave-damping member 4 has the L-structure comprising the vertical plate 5 and immersed horizontal plate 6.

Figure 6:
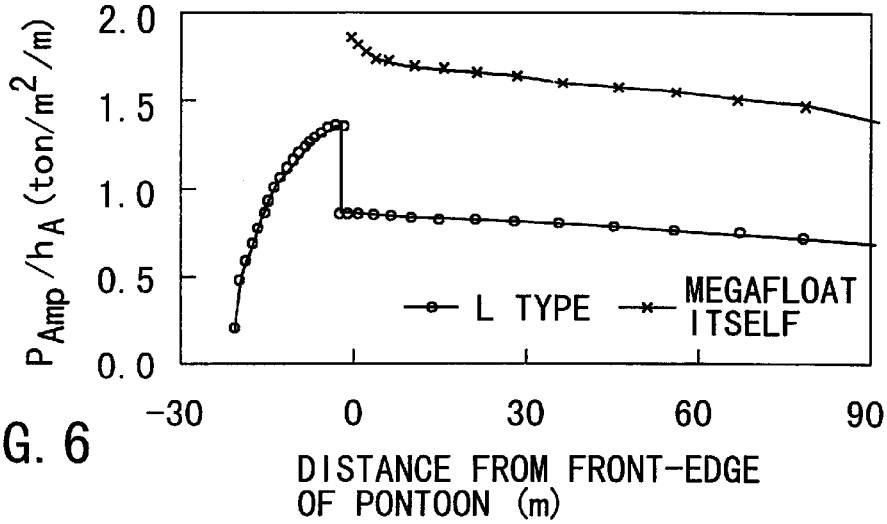
FIG. 6 is a graph showing a relationship between a distance from a front end of the mega-float according to the first embodiment and a fluctuating pressure/amplitude distribution.
Figure 7:
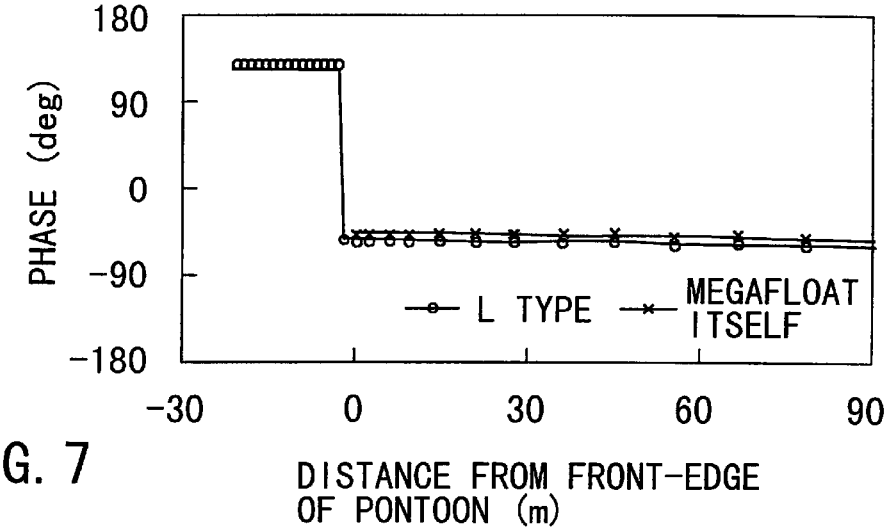
FIG. 7 is a graph showing a pressure fluctuation phase distribution in the first embodiment.

FIG. 6 is a graph showing a relationship between a distance from the front end (upstream-side end) of the mega-float and a distribution of a fluctuating pressure amplitude acting on the mega-float. In the graph, (x) indicates a case of a mega-float without a wave-damping member, and (○) indicates a case of the mega-float 1 having the L-shaped wave-damping member 4 of the present invention. (A region with negative values in the abscissa is associated with the wave-damping member.) As is clear from the graph, in the case of the mega-float without the wave-damping member, a great pressure acts on the front end and gradually and slightly decreases away from the front end. In the case of the mega-float 1 with the L-shaped wave-damping member 4, it is understood that a great pressure acts on the wave-damping member 4 but the pressure acting on the front end of the mega-float 1 decreases to about ½. FIG. 7 is a graph showing a phase distribution of pressure fluctuation, and it is understood that the phases in pressure fluctuation of the mega-float 1 and wave-damping member 4 are reversed.

Figure 8:
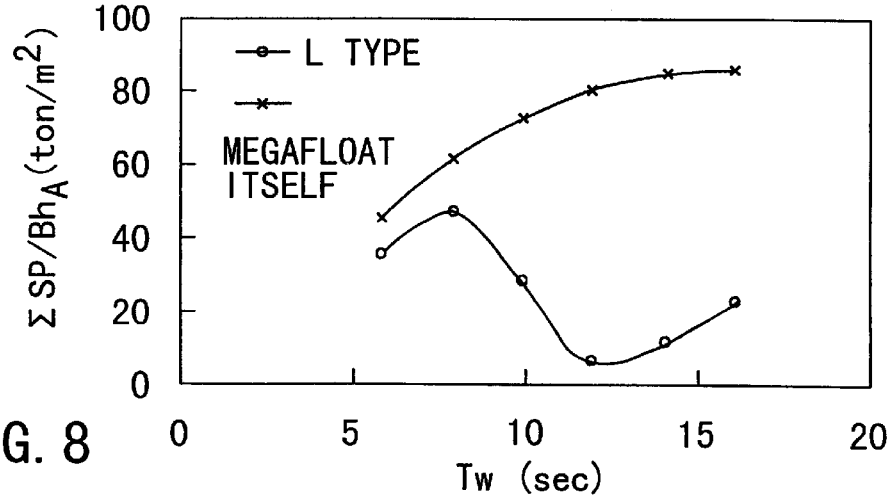
FIG. 8 is a graph showing, on a wave cycle basis, a pressure integration value up to 50 m from the front end of the mega-float in the first embodiment.

FIG. 8 is a graph showing, on a wave cycle basis, a pressure integration value up to 50 m from the front end of the mega-float 1. It is understood that a fluctuating pressure on the immersed horizontal plate 6 of wave-damping member 4 (with a value obtained by subtracting a pressure on the upper surface of the immersed horizontal plate 6 from a pressure on the lower surface of the plate 6) and a fluctuating pressure on the bottom surface of the front end portion of mega-float 1 have opposite phases and cancel each other. Consequently, a pressure integration value of wave (wave force) acting on the front end portion of mega-float 1 decreases, in particular, on a long-cycle side.

Figure 9:
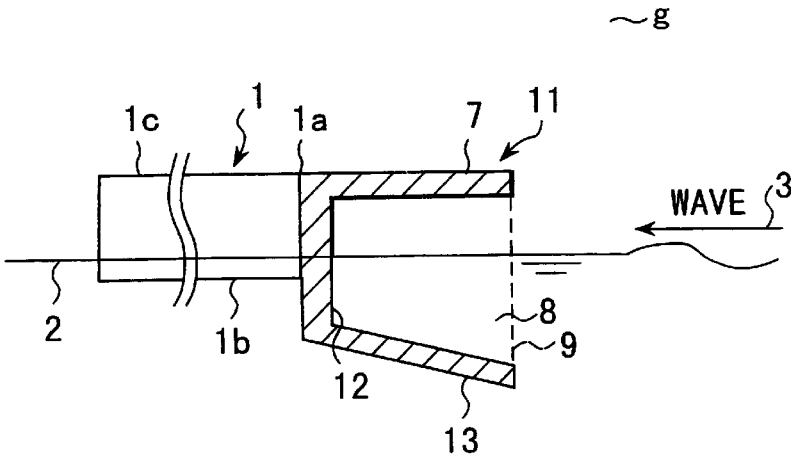
FIG. 9 is a side view showing an inclined-type wave-damping member according to a second embodiment of the present invention.

FIG. 9 shows a second embodiment of the present invention. The structural elements common to those in the first embodiment are denoted by like reference numerals and a description thereof is omitted. An inclined-type wave-damping member 11 according to this embodiment comprises a vertical plate 12 provided on the front end portion 1*a* of mega-float 1, and an immersed inclined plate 13. The vertical plate 12 penetrates the water surface and extends downward from the bottom surface 1*b* of the mega-float 1. The inclined plate 13 extends forward in an inclined downward direction from a lower end portion of the vertical plate 12.

According to the mega-float 1 with the wave-damping member 11 of the present embodiment, if the mega-float 1 in its floating state receives incoming waves, a fluctuating pressure on the immersed inclined plate 13 of wave-damping member 11 (with a value obtained by subtracting a pressure on the upper surface of the immersed inclined plate 13 from a pressure on the lower surface of the plate 13) and a fluctuating pressure on the bottom surface of the front end portion 1*a* of mega-float 1 have opposite phases and cancel each other. Consequently, a pressure integration value of wave (wave force) acting on the front end portion of mega-float 1 decreases and the fluctuation can be reduced.

Figure 10:
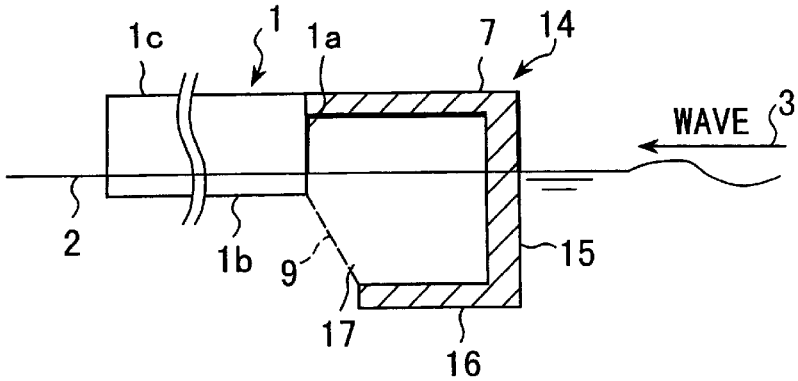
FIG. 10 is a side view of a reversed-L-shaped wave-damping member according to a third embodiment of the invention.

FIG. 10 shows a third embodiment of the present invention. The structural elements common to those in the first embodiment are denoted by like reference numerals and a description thereof is omitted. A reversed-L-shaped wave-damping member 14 according to this embodiment comprises a vertical plate 15 and an immersed plate 16. The vertical plate 15 extends downward from a front end portion of the extension deck 7 extending forward (i.e. to the upstream side of waves) from the front end portion 1*a* of mega-float 1. The vertical plate 15 is spaced apart from the front end face of the mega-float 1 and extends downward to a level below the bottom surface 1*b* of mega-float 1. The immersed plate 16 extends rearward from a lower end portion of the vertical plate 15. A water passage member 17 is provided between a rear end portion of the immersed plate 16 and a lower corner portion of the front end portion 1*a* of mega-float 1.

According to the mega-float 1 with the wave damping member 14 of the present embodiment, if the mega-float 1 in its floating state receives incoming waves, a fluctuating pressure on the immersed inclined plate 16 of wave-damping member 14 (with a value obtained by subtracting a pressure on the upper surface of the immersed inclined plate 16 from a pressure on the lower surface of the plate 16) and a fluctuating pressure on the bottom surface of the front end portion 1*a* of mega-float 1 have opposite phases and cancel each other. Consequently, a pressure integration value of wave (wave force) acting on the front end portion of mega-float 1 decreases and the fluctuation can be reduced.

In this embodiment, the immersed plate 16 extending backward is provided such that it is bent at right angles from the lower end of the vertical plate 15. However, the lower end of the vertical plate 15 may be projected downward to a level lower than the lower surface of the immersed plate 16.

Figure 11:
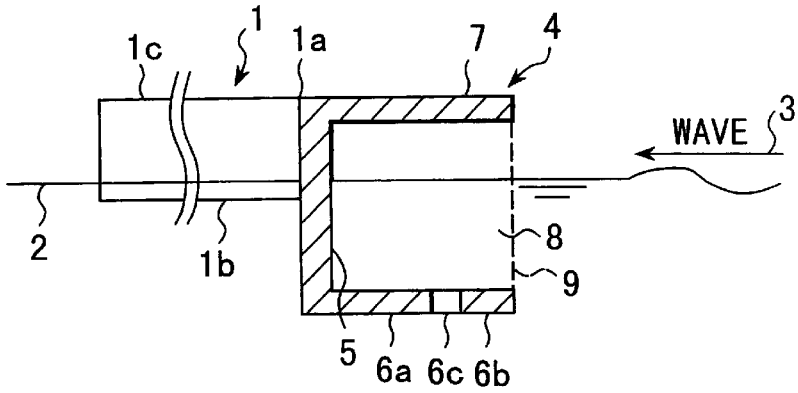
FIG. 11 is a side view of a wave-damping member according to a fourth embodiment of the invention.

FIG. 11 shows a fourth embodiment of the invention. The structural elements common to those in the first embodiment are denoted by like reference numerals and a description thereof is omitted. In this embodiment, an opening 6*c* is provided in the immersed horizontal plate 6. Specifically, the immersed horizontal plate 6 is constructed such that a rear horizontal plate 6*a* fixed to the lower end of the vertical plate 5 and a front horizontal plate 6*b*, which is spaced apart from the rear horizontal plate 5 with a proper interval, are coupled to each other.

Figure 12:
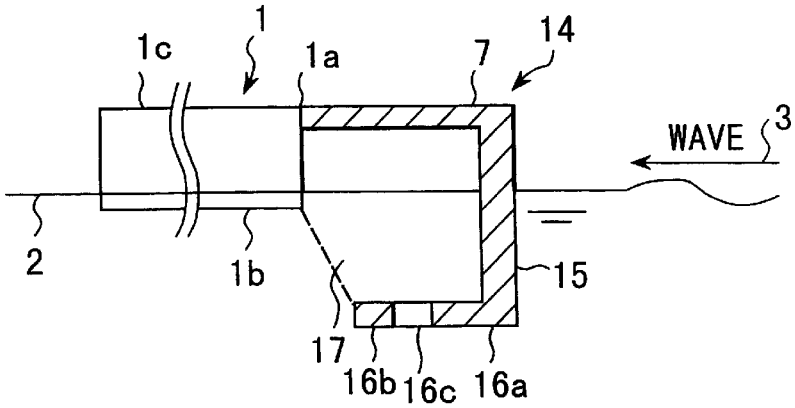
FIG. 12 is a side view of a wave-damping member according to a fifth embodiment of the invention.

FIG. 12 shows a fifth embodiment of the invention. The structural elements common to those in the third embodiment are denoted by like reference numerals and a description thereof is omitted. In this embodiment, an opening 16*c* is provided in the immersed horizontal plate 16. Specifically, the immersed horizontal plate 16 is constructed such that a front horizontal plate 16*a* fixed to the lower end of the vertical plate 15 and a rear horizontal plate 16*b*, which is spaced apart from the front horizontal plate 16*a* with the opening 16*c*, are coupled to each other.

FIGS. 13A through 17D show, on a wave cycle basis, calculation results on pressure integration in a range of 50 m from the front end of the mega-float, with the dimensions of the wave-damping member varied systematically (corresponding to FIG. 8). In the calculations, it is supposed that the water depth is 20 m, the wave height is 2 m and the direction of wave is 0° (the direction of wave coinciding with the longitudinal direction of the mega-float). FIGS. 13A, 14A, 15A, 16A and 17A show dimensions of respective portions of mega-floats shown in FIGS. 13B to 17B, which dimensions were used in the calculations. FIGS. 13C to 17C and 13D to 17D show calculation results.

General evaluations of wave-damping effects of the respective embodiments, which were made based on the calculation results, are indicated by symbols ◎, ○, and Δ in "REMARKS" in each of FIGS. 13A, 14A, 15A, 16A and 17A with corresponding results illustrated in FIGS. 13C–13D, 14C–14C 15C–15D, 16C–16D and 17C–17D, respectively. It is understood that in each case the pressure integration value (wave force) greatly decreased, compared to the mega-float without the wave-damping member of the present invention (indicated by "X" in each graph).

From FIGS. 13A to 13D, it is understood that as the dimension D increases, the control force decreases and the cycle at which the control force takes a minimum value becomes shorter. In addition, as the dimension S increases, the cycle at which the control force takes a minimum value becomes longer.

From FIGS. 14A to 14D, it is understood that if the dimension D1 is equal, the same tendency as with the L-type is observed.

From FIGS. 15A to 15D, it is understood that the greater the dimension Dl, D2, the smaller the control force. In addition, as the dimension D2 increases, the force decreases with a shorter cycle. Moreover, as the dimension S2 increases, the cycle at which the control force takes a minimum value becomes longer.

From FIGS. 16A to 16D, it is understood that as the dimension S2 increases, the cycle at which the control force takes a minimum value becomes longer.

From FIGS. 17A to 17D, it is understood that the immersed horizontal plate decreases in size and the long-cycle control force increases, as compared to the reversed-L-shaped type of the same size.

According to the present invention, as has been described above, there is provided a wave-resistant mega-float whereby the waves can be efficiently damped with the wave-damping member provided on the mega-float, without installing a stationary breakwater, etc. in an offshore region, and fluctuations due to a wide range of wave cycles and high waves can be reduced.

In addition, the incoming waves can be broken at the time of passing through the water passage member, the wave energy is attenuated, and the adverse effect of the incoming waves upon the mega-float including the wave-damping member can be reduced.

Furthermore, the area of the deck of the megafloat can be increased. It is also possible to prevent vessels, etc. from colliding with the front end of the immersed horizontal plate or immersed inclined plate.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A wave-resistant mega-float having a floating body with a front end portion and a bottom surface comprising:

a first flat plate provided on the front end portion of said floating body of the wave-resistant mega-float and extending downward below the bottom surface of the floating body penetrating a water surface, said front end portion of the floating body being located on an upstream side in a direction from which waves travel; and a second flat plate, having a through hole for passing water therethrough, attached substantially perpendicularly to a lower end portion of the first flat plate such that the second flat plate extends toward the upstream side.

2. A wave-resistant mega-float according to claim 1, further comprising a third flat plate attached to an upper end portion of the first flat plate such that the third flat plate extends toward the upstream side.

3. A wave-resistant mega-float according to claim 2, further comprising a water passage member, attached to the second flat plate and the third flat plate, for passing water to a region between the second flat plate and the third flat plate.

4. A wave-resistant mega-float according to claim 3, wherein said water passage member is one selected from a group consisting of a net member, a porous member, a slit plate member and a grating member.

5. A wave-resistant mega-float having a floating body with a front end portion and a bottom surface comprising:

a first flat plate provided on the front end portion of said floating body of the wave-resistant mega-float, and extending downward below the bottom surface of the floating body penetrating a water surface, said front end portion of the floating body being located on an upstream side in a direction from which waves travel; and a second flat plate attached to a lower end portion of the first flat plate and extending toward the upstream side in an inclined downward direction;

a third flat plate attached to an upper end portion of the first flat plate such that the third flat plate extends toward the upstream side; and a water passage member, attached to the second flat plate and the third flat plate, for passing water to a region between the second flat plate and the third flat plate.

6. A wave-resistant mega-float according to claim 5, wherein said water passage member is one selected from a group consisting of a net member, a porous member, a slit plate member and a grating member.

7. A wave-resistant mega-float according to claim 5, wherein said second flat plate has a through-hole.

8. A wave-resistant mega-float having a floating-body with a front end portion and a bottom surface comprising:

a first flat plate provided on the front end portion of said floating body of the wave-resistant mega-float, which front end portion is located on an upstream side in a direction from which waves travel, the first flat plate extending toward the upstream side from the floating body;

a second flat plate attached to the first flat plate and extending downward below the bottom surface of the floating body penetrating a water surface; and a third flat plate attached to the second flat plate and extending toward the floating body; and a water passage member, provided between the third flat plate and the front end portion of the floating body, for passing water therethrough.

9. A wave-resistant mega-float according to claim 8, wherein said water passage member is one selected from the group consisting of a net member, a porous member, a slit plate member and a grating member.

10. A wave-resistant mega-float according to claim 8, wherein said second flat plate has a through-hole.

* * * * *

UNITED STATES PATENT AND TRADEMARK OFFICE

CERTIFICATE OF CORRECTION

PATENT NO. : 6,408,780 B1
DATED : June 25, 2002
INVENTOR(S) : Masahiko Ozaki et al.

It is certified that error appears in the above-identified patent and that said Letters Patent is hereby corrected as shown below:

Title page,
Item [73], should read -- Assignee: Mitsubishi Heavy Industries, Ltd., Tokyo (JP) --

Signed and Sealed this

Fourteenth Day of October, 2003

JAMES E. ROGAN
*Director of the United States Patent and Trademark Office*